US006525280B2

(12) United States Patent
Chan et al.

(10) Patent No.: US 6,525,280 B2
(45) Date of Patent: Feb. 25, 2003

(54) SWITCH DESIGNED FOR MANUAL ACTUATION OF SEVERAL SWITCHING ELEMENTS

(75) Inventors: Yat Fung Chan, Hong Kong (HK); Wei Cui, Hong Kong (HK)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/933,100

(22) Filed: Aug. 20, 2001

(65) Prior Publication Data

US 2002/0023828 A1 Feb. 28, 2002

(30) Foreign Application Priority Data

Aug. 23, 2000 (EP) ..... 00402340

(51) Int. Cl.[7] ..... H01H 25/04
(52) U.S. Cl. ..... 200/6 A; 200/4; 200/5 R
(58) Field of Search ..... 200/4, 5 R, 6 A, 200/17 R, 18; 345/161; 463/36–38

(56) References Cited

U.S. PATENT DOCUMENTS 4,611,102 A * 9/1986 Ishida ..... 200/5 R
4,698,464 A * 10/1987 Tanaka et al. ..... 200/5 R
4,947,461 A * 8/1990 Yoshioka et al. ..... 200/5 R
5,034,572 A * 7/1991 Kouno et al. ..... 200/5 R
5,689,095 A * 11/1997 Kawase ..... 200/5 R

FOREIGN PATENT DOCUMENTS

| | | | |
|---|---|---|---|
| DE | 9210286 | 9/1992 | ..... H01H/13/20 |
| EP | 0587406 A2 | 3/1994 | ..... H01H/25/04 |

OTHER PUBLICATIONS

European Search Report citing the above listed references: AA, AL, AM, Jan. 16, 2001.

* cited by examiner

*Primary Examiner*—Michael Friedhofer
(74) *Attorney, Agent, or Firm*—Joseph S. Tripoli; Robert D. Shedd; Reitseng Lin

(57) ABSTRACT

Within electronic devices in many cases there exists a need for a manual individual actuation of several switching elements for performing an adjustment of different parameters by a single switch, especially for a pleasure appearance of a front panel and for saving place on the panel.

It is an object to provide a switch for this purpose ensuring among others low costs, small size, high reliability, convenient actuation and having good properties for being mounted on a printed circuit board.

The actuation means for several switching elements includes an actuating plate being pivotably mounted in a housing on two perpendicular axes and a push-button located within a central opening of said plate.

11 Claims, 2 Drawing Sheets

SWITCH DESIGNED FOR MANUAL ACTUATION OF SEVERAL SWITCHING ELEMENTS

FIELD OF THE INVENTION

The invention relates to a switch designed for manual actuation of several switching elements.

BACKGROUND OF THE INVENTION

Within electronic equipments including a high number of controllable or adjustable elements and a corresponding high number of operating elements like push-buttons, knobs, shiftable elements etc., a need exists for actuating several functions by means of a single switch. This is the case especially for improving the optical appearance of a control panel and to reduce the space occupied by the operating elements on the surface of the control panel.

Switches with a manual actuation means allowing individual actuation of several switching elements have already been proposed, for instance in patent application EPO 587 406 and utility model DE92 10 286.

SUMMARY OF THE INVENTION

Practically there exists a number of requirements for such multifunction switches. Some of them are among others low costs, small size, high reliability and good properties for being mounted on a printed circuit board (PCB).

It is an object of the present invention to provide a multifunction switch meeting said requirements in a more extended form than switches according to prior art.

The invention proposes a switch designed for an individual actuation of one of a plurality of switching elements including a housing and manual actuation means mounted in said housing for individually actuating said several switching elements. The manual actuation means comprises an actuating plate with two pins defining a first axis and two pins defining a second axis perpendicular to the first axis. The housing comprises slots for cooperation with the pins.

This feature enables the totally reliable actuation of only one of four separate switching elements by pressing the upper part, the right part, the lower part or the left part of the surface of the plate as two switching elements cannot be pressed at a time. Said plate may include a number of slightly curved convex partial areas each area being adapted to pivot the plate in different directions. The plate may have the form of an undivided doughnut shaped button.

According to one embodiment of the invention, said plate is provided at its rear side with at least one rod extending perpendicular to the plane of said plate into the interior of the housing and abutting against movable parts of the switching elements located at the back side of said housing. Said pins may form an integral part of said rods.

According to a further embodiment of the invention the housing of the switch includes between said plate and said switching elements a guiding plate with a central opening acting as a guidance for said push-button and four openings provided for the passage of said rods. Therein the guiding plate carries at its first surface a number of rods abutting against said housing member and at its opposite surface a number of rods abutting against said switch panel.

According to a further development of the invention said housing member forms an integral part of a cabinet of a device like a CD-player and the switch panel forms an integral part of a printed circuit board located within said cabinet.

According to a further development of the invention several push-buttons are located in several openings of the plate side by side or one above the other whereby the number of the individually actuable switching elements can be further increased.

As the undivided plate is pivotable about two perpendicular axes in each case in two different directions so that that totally the plate can be pivoted in four different directions it can be used for example to move a cursor on a screen in four perpendicular directions, i.e. to any desired point on the screen, especially for navigation purposes. The arrangement of the plate and the central button according to the invention allows the individual manual actuating of any one of five separate switching elements or tact switches by a single switch.

The switch according to the invention offers a number of advantages. A high cost saving is achieved as five switching elements or functions can be actuated individually by one switch only instead of a conventional multidirectional switch. Additionally a space saving is achieved as the arrangement according to the invention facilitates the manufacture of more compact and light units. Especially high density mounting on a printed circuit board (PCB) is permitted and low profile and light weight are realized greatly. Furthermore appearance simplicity with web feeling and stylish high class image are achieved compared with conventional segmental style design. Switch mechanism and contact structure offer the best panel design flexibility. Less fastening means enables an easy assembling. Internal isolated momentary mechanism and contact structure make the structure more tolerant to the warping of a PCB.

The switch according to the invention provides a high number of different advantageous applications. For example it can be used for the operation and setting of data input equipments, especially pointing devices such as mouse and micro trackball, and communication equipments. Another application are devices using micro switches as operating switches in different electronic apparatus. It may be applied in car audio systems, car navigation systems, for adjusting the side mirror in an automobile, furthermore for cursor control of a graphic input device and audio devices such as equalizers. Finally it can be used for operating various adjustments for such items, especially for portable electronic equipments. Further possible fields of application may be all types of audio products, business machines, communication equipments, measuring instruments, television receivers, video recorders, in particular in compact version requiring high density mounting such as cellular phones.

BRIEF DESCRIPTION OF THE DRAWINGS

One embodiment of the invention will now be described with reference to the accompanying drawing. Within the drawing

DETAILED DESCRIPTION OF A PREFERRED EMBODIMENT

Figure 1:
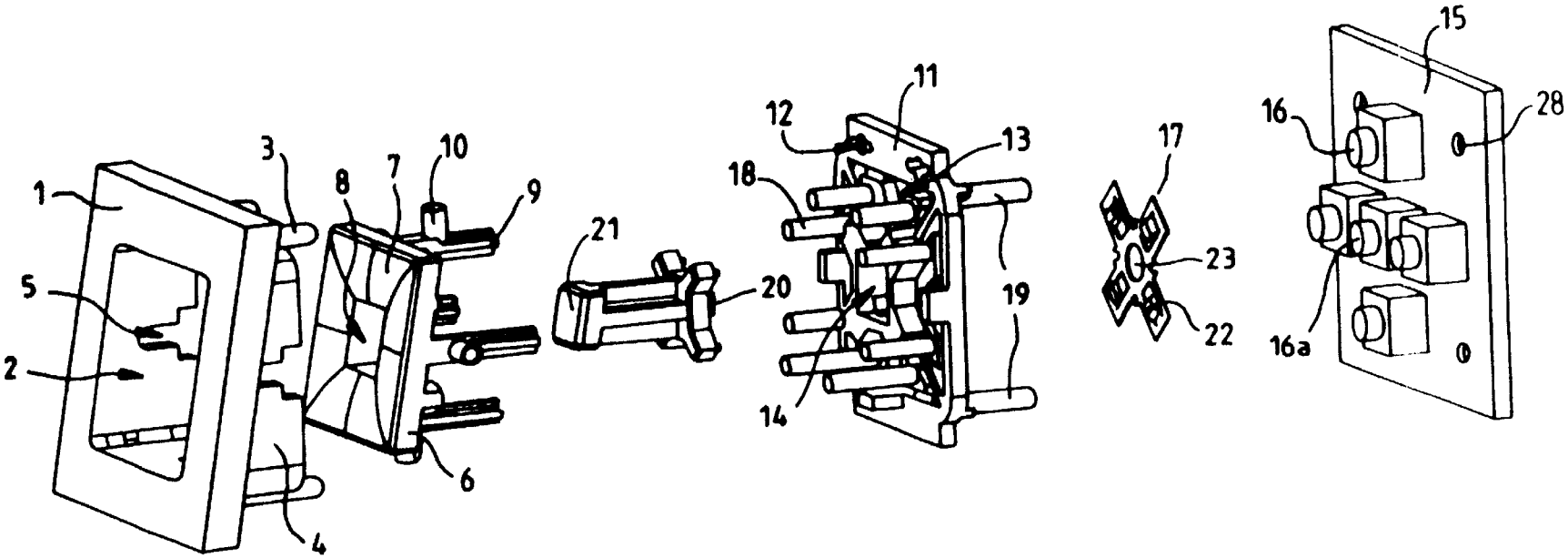
FIG. 1 shows all elements of a switch according to the invention in an exploded view.

FIG. 1 shows a housing member 1 of a switch including a rectangular opening 2, four rods 3 at the rear side and four sidewalls 4 at the rear side each provided with a slot 5. A rectangular actuating plate 6 with the dimensions of the opening 2 includes several slightly curved surface areas 7, a central opening 8, four rods 9 extending from the rear side and each provided with a pin 10 directed perpendicular to the rods 9. The actuating plate 6 is inserted into the opening 2 of the housing member 1, the four pins 10 cooperating with the slots 5. In this way the operating plate 6 can pivot within the housing member I in both directions about a horizontal axis defined by two opposite pins 10 and about a vertical axis defined by the other two opposite pins 10. Furthermore a push-button 21 having a foot part 20 is provided which fits into the central opening 8 of the actuating plate 6.

Next a guiding plate 11 is provided including four holes 12 at its upper and lower border aligned with the rods 3, four openings 13 aligned with the rods 9 and a central rectangular opening 14 aligned with the push-button 21. The rods 3 of the housing member 1 are inserted into the holes 12 so that the housing member 1 and the guiding plate 11 are firmly combined and from a rigid structure. Rods 18 of the guiding plate 11 abut against the housing member 1 whereas four rods 19 of the guiding plate 11 are inserted into four holes 28 of a switch panel 15 provided at the right end of the structure.

The switch panel 15 carries at its surface five switching elements 16 in the arrangement shown. Between the guiding plate 11 and the switch panel 15 a spring plate 17 is provided with four spring-like members 22 aligned with the rods 9. A hole 23 within the spring plate 17 enables the passage of the foot part 20 of the push-button 21 for actuating the central switching element 16*a*.

In the following the operation of said switch will be described. For actuating one of the switching elements 16 the operator pushes or presses the upper part, the right part, the lower part or the left part of the plate 6 or the push-button 21 so that the corresponding switching element 16 on the switch panel 15 is actuated by one of the rods 9 or the foot part 20 of the push-button 21. Thus the separated switching elements 16 can be actuated by an operator individually only by said single plate 6 and the push-button 21.

The housing member I may be an integral part of the cabinet of a CD player whereas the switch panel 15 may be mounted on a printed circuit board mounted within said cabinet. The other elements like elements 6, 21, 11, 17 are inserted during the assembling of cabinet and printed circuit board.

Figure 2:
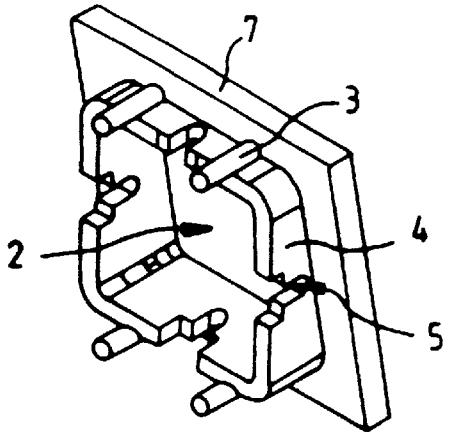
FIG. 2 is a perspective view of a housing member of the switch.

FIG. 2 shows the housing member 1 from the rear side with the four sidewalls 4 each including a slot 5 and the central opening 2 for receiving the rectangular plate 6 of FIG. 1 as well as the four rods 3 being inserted into the holes 12 of the guiding plate 11 according to FIG. 1.

Figure 3:
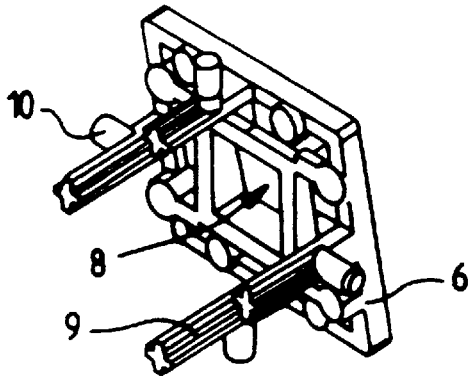
FIG. 3 is a perspective view of an actuating plate shown in FIG. 1.

FIG. 3 shows the actuating plate 6 from the rear side including the four rods 9 abutting against the switching elements 16, the four pins 10 forming an integral part with the rods 9 and cooperating with the slots 5 in FIGS. 1 and 2 as well as the central opening 8 for receiving the push-button 21.

Figure 4:
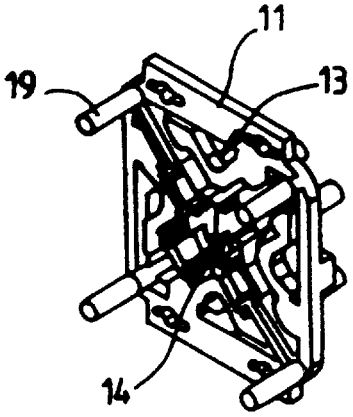
FIG. 4 is a guiding plate provided for guiding the rods of the operating plate and the push-button and FIG. 5 is a spring plate for actuating the switching elements.

FIG. 4 shows the guiding plate 11 from the right side in FIG. 1 including the four rods 19, the four openings 13 for the passage of the four rods 9 and the central opening 14 acting as a guidance for the push-button 21.

Figure 5:
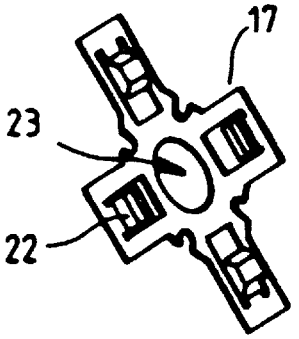

FIG. 5 shows the spring plate 17 including four spring elements 22 being interposed between the ends of the rods 9 and the corresponding four switching elements 16 of the switch panel 15 for ensuring a sudden actuation of the switching elements 16 by the rods 9.

What is claimed is:

1. Switch designed for an individual actuation of one of a plurality of switching elements including a housing and manual actuation means mounted in said housing for individually actuating said plurality of switching elements, wherein the manual actuation means comprises an actuating plate with two pins defining a first axis and two pins defining a second axis perpendicular to the first axis and wherein the housing comprises slots for cooperation with the pins, wherein said plate is provided at a rear side with at least one rod extending perpendicular to the plate into an interior of the housing of the switch and abutting against movable parts of the switching elements of a switch panel located at a back side of said housing, wherein the housing of the switch includes between said plate and said switching elements a guiding plate with a central opening acting as a guidance for a push-button and four openings provided for passage of said at least one rod, and wherein the guiding plate carries at a first surface a number of rods abutting against said housing and at its opposite surface a number of rods abutting against said switch panel.

2. Switch according to claim 1, wherein a push-button is located within a central opening of said plate.

3. Switch according to claim 1, wherein said plate includes a number of slightly curved convex partial areas.

4. Switch according to claim 1, wherein said plate is shaped as an undivided doughnut shaped button.

5. Switch according to claim 1, wherein said pins form an integral part of said at least one rod.

6. Switch designed for an individual actuation of one of a plurality of switching elements including a housing and manual actuation means mounted in said housing for individually actuating said plurality of switching elements, wherein the manual actuation means comprises an actuating plate with two pins defining a first axis and two pins defining a second axis perpendicular to the first axis, wherein the housing comprises slots for cooperation with the pins, wherein said actuating plate is provided at a rear side with at least one rod abutting against movable parts of the switching elements, wherein a guiding plate has at least one opening provided for passing of said at least one rod, and wherein the guiding plate carries at a first surface a number of rods protruding towards said housing and, at a second surface opposite said first surface, a number of rods inserted into a switch panel carrying the switching elements.

7. Switch according to claim 6, wherein a push-button is located within a central opening of said actuating plate.

8. Switch according to claim 7, wherein the guiding plate has a central opening acting as a guidance for a push-button.

9. Switch according to claim 6, wherein one of said pins forms an integral part of said at least one rod.

10. Switch according to claim 6, wherein the guiding plate has a plurality of holes whereto rods of the housing are inserted.

11. Switch according to claim 6, wherein a spring plate is provided between the guiding plate and the switch panel.

* * * * *